US009908731B2

(12) United States Patent
Morishita et al.

(10) Patent No.: US 9,908,731 B2
(45) Date of Patent: Mar. 6, 2018

(54) PAPER CONVEYING MECHANISM FOR PRINTING APPARATUS

(71) Applicant: STAR MICRONICS CO., LTD., Shizuoka (JP)

(72) Inventors: Masaaki Morishita, Shizuoka (JP); Yuji Suzuki, Shizuoka (JP); Yasuhiko Hagi, Shizuoka (JP)

(73) Assignee: STAR MICRONICS CO., LTD., Shizuoka-Shi (JP)

( * ) Notice: Subject to any disclaimer, the term of this patent is extended or adjusted under 35 U.S.C. 154(b) by 129 days.

(21) Appl. No.: 14/620,302

(22) Filed: Feb. 12, 2015

(65) Prior Publication Data

US 2015/0151940 A1 Jun. 4, 2015

Related U.S. Application Data

(63) Continuation of application No. PCT/JP2013/074965, filed on Sep. 17, 2013.

(30) Foreign Application Priority Data

Sep. 28, 2012 (JP) ..... 2012-215861

(51) Int. Cl.
*B65H 23/00* (2006.01)
*B41J 15/04* (2006.01)
(Continued)

(52) U.S. Cl.
CPC ..... *B65H 23/00* (2013.01); *B41J 15/042* (2013.01); *B41J 15/046* (2013.01);
(Continued)

(58) Field of Classification Search
CPC .. B65H 23/00; B65H 23/048; B65H 23/1955; B65H 26/02; B65H 29/008; B65H 43/04;
(Continued)

(56) References Cited

U.S. PATENT DOCUMENTS 3,807,725 A * 4/1974 Bookless ..... B65H 3/22 271/170
3,874,621 A * 4/1975 Blair ..... G01D 15/14 226/88

(Continued)

FOREIGN PATENT DOCUMENTS

JP 2706193 5/1993
JP 4183309 2/2000

(Continued)

*Primary Examiner* — Michael E Gallion
(74) *Attorney, Agent, or Firm* — Lex IP Meister, PLLC

(57) ABSTRACT

A paper conveying mechanism includes an elastic urging member provided on each side surface of an upper guide. The urging member includes a projecting portion that projects toward a side guide forming each end of a paper conveying path. An outer width of the upper guide inclusive of the projecting portion is greater than an inner width of the side guides. When a printer cover is closed, the upper guide is urged by the urging member substantially to the center of the inner width of the side guides, thereby producing gaps of substantially equal size on both sides of the upper guide in the paper width direction.

10 Claims, 9 Drawing Sheets

Printing apparatus of the embodiment (with printer cover opened)

(51) Int. Cl.

| | |
|---|---|
| ***B65H 23/04*** | (2006.01) |
| ***B65H 23/195*** | (2006.01) |
| ***B65H 26/02*** | (2006.01) |
| ***B65H 43/04*** | (2006.01) |
| ***B65H 29/00*** | (2006.01) |

(52) U.S. Cl.
CPC ..... *B65H 23/048* (2013.01); *B65H 23/1955* (2013.01); *B65H 26/02* (2013.01); *B65H 29/008* (2013.01); *B65H 43/04* (2013.01); *B65H 2402/44* (2013.01); *B65H 2402/443* (2013.01); *B65H 2402/45* (2013.01); *B65H 2404/6111* (2013.01); *B65H 2404/74* (2013.01); *B65H 2407/30* (2013.01); *B65H 2511/142* (2013.01); *B65H 2601/2531* (2013.01)

(58) Field of Classification Search
CPC ..... B65H 2402/44; B65H 2402/443; B65H 2402/45; B65H 2404/6111; B65H 2404/74; B65H 2407/30; B65H 2511/142; B65H 2601/2531; B41J 15/042; B41J 15/046
See application file for complete search history.

(56) References Cited

U.S. PATENT DOCUMENTS 4,908,673 A * 3/1990 Muramatsu ..... G03G 15/234 271/171
5,172,178 A * 12/1992 Oushiden ..... G03G 15/5095 399/376
5,637,070 A * 6/1997 Sasai ..... B41J 11/0005 162/271
5,647,585 A * 7/1997 Cheong ..... B65H 1/266 271/171
5,700,099 A * 12/1997 Kobayashi ..... B41J 13/10 347/104
6,250,624 B1 * 6/2001 Kiyohara ..... B41J 11/005 226/196.1
6,375,319 B1 * 4/2002 Kamano ..... B41J 13/025 347/104
6,435,446 B1 * 8/2002 Matsuzawa ..... B65H 16/00 242/422.4
6,543,761 B2 * 4/2003 Endo ..... B65H 3/5223 271/110
2001/0022427 A1 * 9/2001 Ito ..... B65H 5/06 271/272
2002/0085242 A1 * 7/2002 Kim ..... H04N 1/00708 358/449
2005/0214054 A1 * 9/2005 Hoshino ..... B41J 3/4075 400/613
2006/0008312 A1 * 1/2006 Sago ..... B41J 11/0015 400/642
2007/0063425 A1 * 3/2007 Tsujinishi ..... B65H 9/08 271/145
2008/0199239 A1 * 8/2008 Kohira ..... B26D 1/085 400/621
2008/0252001 A1 * 10/2008 Inoue ..... B65H 29/40 271/270
2009/0087238 A1 * 4/2009 Furuyama ..... B41J 11/0035 399/389
2009/0245915 A1 * 10/2009 Kawaguchi ..... B26D 1/085 400/621
2009/0317163 A1 * 12/2009 Kohira ..... B26D 1/085 400/621
2011/0158731 A1 * 6/2011 Suzuki ..... B26D 1/085 400/621
2011/0241275 A1 * 10/2011 Matsuo ..... B42C 1/125 270/58.08
2012/0025451 A1 * 2/2012 Ohkura ..... B65H 1/266 271/121
2012/0044309 A1 * 2/2012 Wanibuchi ..... B41J 15/042 347/104
2012/0127229 A1 * 5/2012 Fukasawa ..... B41J 11/0065 347/16
2013/0076821 A1 * 3/2013 Yamauchi ..... B41J 19/202 347/14
2013/0183075 A1 * 7/2013 Kim ..... B41J 15/042 400/619
2013/0271543 A1 * 10/2013 Akatsu ..... B41J 11/00 347/104
2014/0077443 A1 * 3/2014 Doyo ..... B65H 5/062 271/121
2016/0009514 A1 * 1/2016 Tani ..... B65H 1/04 271/234

FOREIGN PATENT DOCUMENTS

| | | |
|---|---|---|
| JP | 2001-213022 | 8/2001 |
| JP | 2003-201041 | 7/2003 |
| JP | 2007-99458 | 4/2007 |
| JP | 2007-099458 | 4/2007 |
| JP | 2008-105781 | 5/2008 |
| JP | 2011-136472 | 7/2011 |

* cited by examiner

Printing apparatus of the embodiment (with printer cover closed)

Printing apparatus of the embodiment (with printer cover opened)

Configuration example of urging member of the embodiment (expanded view)

Another configuration example of urging member of the embodiment

Another configuration example of urging member of the embodiment (expanded view)

PAPER CONVEYING MECHANISM FOR PRINTING APPARATUS

CROSS-REFERENCE TO RELATED APPLICATIONS

This application is a continuation of International Patent Application No. PCT/JP2013/074965, filed on Sep. 17, 2013, which claimed priority of Japanese Patent Application No. 2014-215861 filed on Sep. 28, 2012. The contents of these applications are incorporated herein by reference in their entirety.

BACKGROUND OF THE INVENTION

1. Field of the Invention

The present invention relates to a paper conveying mechanism for a printing apparatus and is particularly suitable for a clamshell printer in which a paper conveying path is formed by a combination of paper-thickness-direction regulating guides and paper-width-direction regulating guides.

2. Description of the Related Art

Hitherto, there have been proposed printers in each of which continuous-form paper that is in a roll is conveyed along a paper conveying path. In such a printer, printing is performed on the continuous-form paper with a print head mounted above the paper conveying path, and the paper is then cut into a piece having a predetermined length by an automatic cutter. In general, such a printer includes a guide mechanism provided around the paper conveying path so that the continuous-form paper is properly conveyed (see Japanese Unexamined Patent Application Publication No. 2011-136472, Japanese Patent No. 2706193, Japanese Unexamined Patent Application Publication No. 2007-99458, and Japanese Patent No. 4183309, for example).

Japanese Unexamined Patent Application Publication No. 2011-136472 and Japanese Patent No. 2706193 each disclose a configuration in which paper is guided by an upper guide and a lower guide that are arranged in a paper thickness direction. Japanese Unexamined Patent Application Publication No. 2007-99458 and Japanese Patent No. 4183309 each disclose a configuration in which paper is guided by side guides that are arranged in a paper width direction so that the skewing of the paper is prevented. Examples of the printer having a paper conveying path formed by paper-thickness-direction regulating guides and paper-width-direction regulating guides include a so-called clamshell printer.

In a general clamshell printer, an upper guide corresponding to a paper-thickness-direction regulating guide is mounted on a printer cover that is openable and closable while a lower guide corresponding to another paper-thickness-direction regulating guide and paper-width-direction regulating guides are mounted on a printer body. When paper is set in a paper holder mounted on the printer body and the printer cover is then closed, a paper conveying path is formed by a combination of the paper-thickness-direction regulating guides and the paper-width-direction regulating guides.

FIG. 6 is a front view of a known printer and illustrates the positional relationship between an upper guide 101 and side guides 102. In FIG. 6, the lower side of the page is defined as the printer bottom side, and the upper side of the page is defined as the printer top side. In the printer illustrated in FIG. 6, paper that is in a roll is set in a paper holder 103 and is conveyed toward the printer top side. The paper is conveyed along the conveying path and discharged from a discharge port (not illustrated) on the front side of the printer. During the conveyance, the paper is guided by the upper guide 101, a lower guide (not illustrated), and the side guides 102 forming paper-width-direction ends of the paper conveying path.

As described above, in the clamshell printer, the upper guide 101 is accommodated between the side guides 102 forming the paper-width-direction ends of the paper conveying path as illustrated in FIG. 6. In such a configuration, if a gap between the upper guide 101 and each of the side guides 102 is completely eliminated, the upper guide 101 and the side guides 102 interfere with each other, causing a possible problem with the opening or closing of the printer cover. To prevent such a problem, a gap needs to be provided between the upper guide 101 and each of the side guides 102 forming the paper-width-direction ends of the paper conveying path.

If a large gap is provided, however, the paper may be taken into the gap and thus be folded. Particularly, a flexible thin paper tends to be folded more frequently. To prevent the paper from being taken into the gap, the gap provided between the upper guide 101 and each of side guides 102 forming the paper-width-direction ends of the paper conveying path needs to be reduced.

The size of the gap can be reduced by improving dimensional accuracy of each of the components of the printer. Even if the dimensional accuracy of the components is improved, however, a large gap is possibly produced when the printer cover is closed. FIG. 7 is a schematic sectional view of the printer illustrated in FIG. 6, seen from the printer bottom side. The upper guide 101 leans toward one side in the paper width direction in a space between the side guides 102 forming the paper-width-direction ends of the paper conveying path, thus producing a larger gap on one side. Most printer covers are designed with some play so as to be openable and closable smoothly. Such play causes deflection of the upper guide 101 toward one side in the paper width direction. There has been a problem of the paper being taken into the gap and folded.

SUMMARY OF THE INVENTION

The present invention is to solve the above problem and to prevent, without impeding the operation of a printer cover, paper from being taken into a gap between an upper guide and each of paper-width-direction regulating guides and thus being folded.

To solve the above problem, according to an aspect of the present invention, an urging member is provided on each side surface of an upper guide facing a paper-width-direction regulating guide. The urging member is of elasticity and provided with a projecting portion that projects toward the paper-width-direction regulating guide forming each paper-width-direction end of a paper conveying path. An outer width of the upper guide inclusive of the projecting portion of the urging member is greater than an inner width of the paper-width-direction regulating guides forming both ends of the paper conveying path.

According to another aspect of the present invention, an urging member is provided on each side surface of a paper-width-direction regulating guide facing the upper guide. The urging member is of elasticity and provided with a projecting portion that projects toward the upper guide. An inner width of the paper-width-direction regulating guides inclusive of the projecting portions of the urging members is smaller than an outer width of the upper guide.

According to each of the above aspects of the present invention, when the printer cover is closed, the upper guide is urged by the urging members to be surely positioned substantially at the center of a space defined by the inner width of the paper-width-direction regulating guides. The upper cover is prevented from leaning toward one side in the paper width direction when the cover is closed. Therefore, gaps of appropriate small size are produced between the upper guide and the respective paper-width-direction regulating guides so that the operation of a printer cover is not impeded while paper is not taken into either of the gaps.

Thus, according to each of the aspects of the present invention, the problem that the paper may be taken into the gap between the upper guide and either of the paper-width-direction regulating guides and thus be folded is prevented without impeding the opening and closing of the printer cover.

DESCRIPTION OF THE PREFERRED EMBODIMENTS

Figure 1:
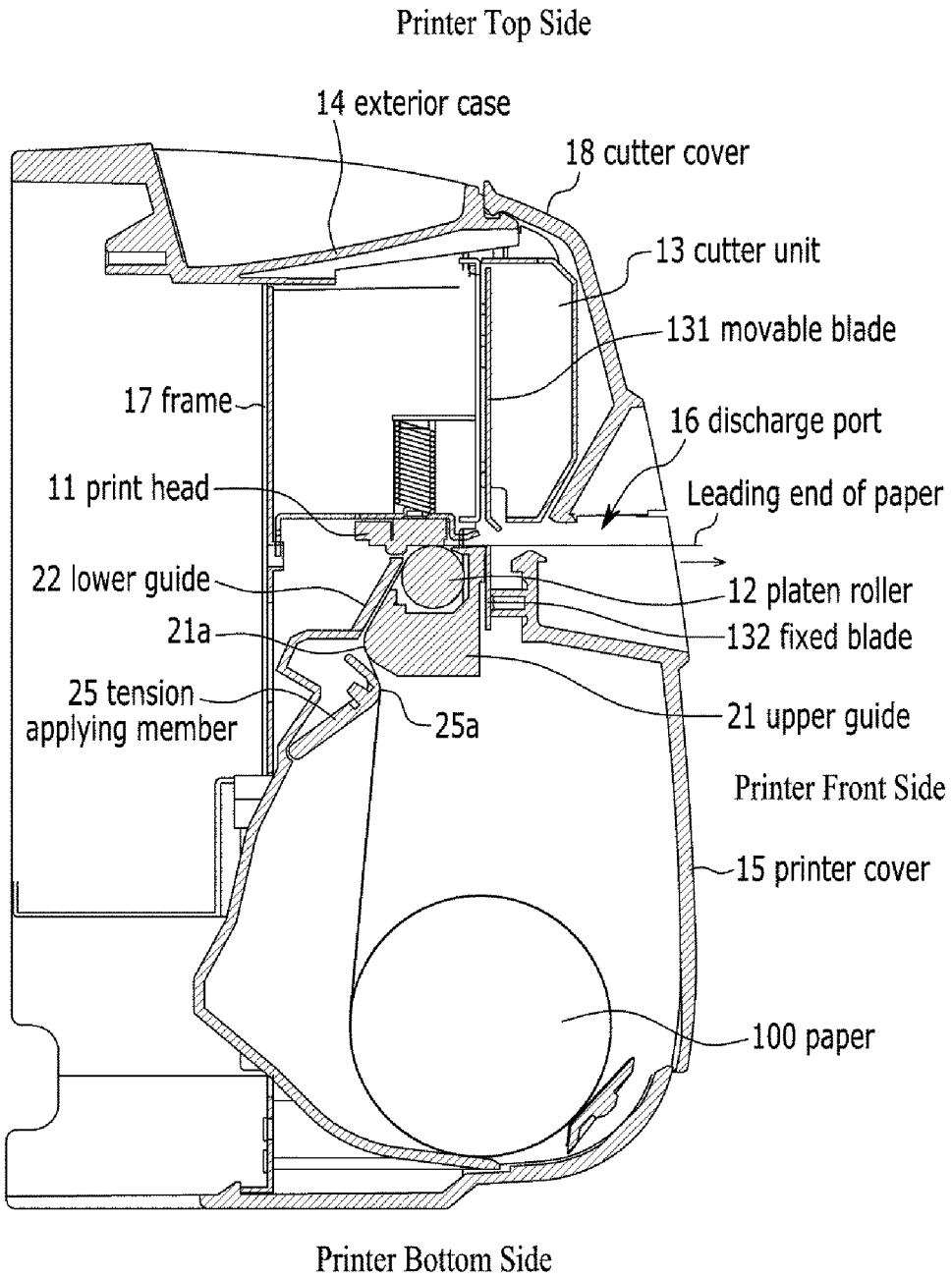
FIG. 1 illustrates an exemplary configuration of a printing apparatus including a paper conveying mechanism according to an embodiment of the present invention.
Figure 2:
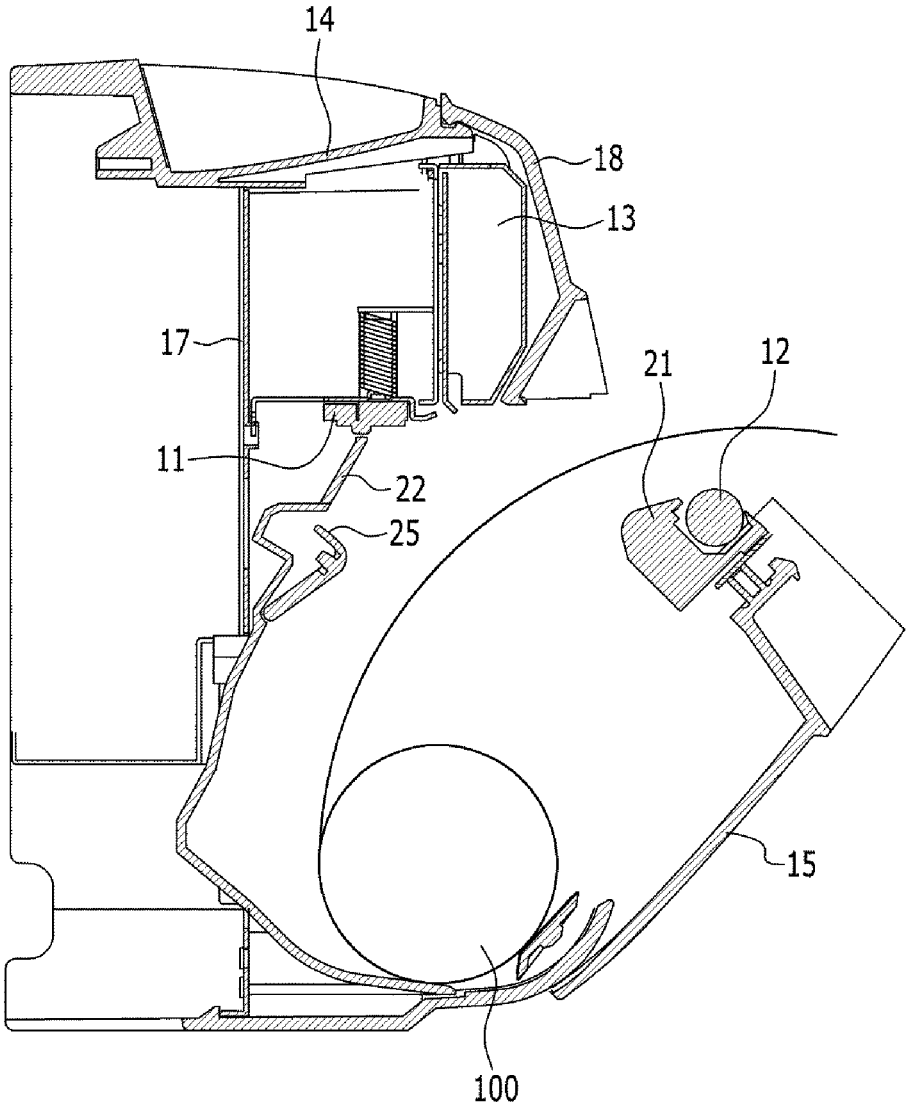
FIG. 2 illustrates the printing apparatus including the paper conveying mechanism according to the embodiment, with a printer cover thereof being open.

An embodiment of the present invention will now be described with reference to the accompanying drawings. FIGS. 1 and 2 illustrate an exemplary configuration of a printing apparatus including a paper conveying mechanism according to the embodiment, with a printer cover thereof being closed in FIG. 1 and opened in FIG. 2. In FIG. 1, the lower side of the page is defined as the printer bottom side, the upper side of the page is defined as the printer top side, and the right side of the page is defined as the printer front side. As illustrated in FIGS. 1 and 2, the leading end of recording paper 100 that is in a roll is fed into a position between a print head 11 and a platen roller 12 of a paper feeding mechanism. The paper 100 having undergone printing performed by the print head 11 is conveyed through a position between a movable blade 131 and a fixed blade 132 of a cutter unit 13, and is discharged by the platen roller 12 to the outside from a discharge port 16 provided between a cutter cover 18 and a printer cover 15. The cutter unit 13 is covered by the cutter cover 18. The cutter cover 18 is attached to an exterior case 14.

To prevent the skewing of the paper 100 that may occur during the conveyance of the paper 100, the printing apparatus according to the embodiment includes a paper conveying mechanism (a guide mechanism). The paper conveying mechanism includes paper-thickness-direction regulating guides and paper-width-direction regulating guides. The paper-thickness-direction regulating guides include an upper guide 21, a lower guide 22, and a tension applying member 25 that are arranged in the paper thickness direction of the paper 100 and thus guide the paper 100. The paper-width-direction regulating guides include side guides 23 (see FIG. 3) arranged at two respective paper-width-direction ends of the paper 100 and thus guide the paper 100.

The printing apparatus according to the embodiment is a clamshell printer and includes the upper guide 21 mounted on the printer cover 15, which is openable and closable, and also includes the lower guide 22, the side guides 23, and the tension applying member 25 that are mounted on a printer body having a frame 17. In a state where the printer cover 15 is opened as illustrated in FIG. 2, the paper 100 that is in a roll is set in a paper holder (not illustrated) mounted on the printer body. Then, the printer cover 15 is closed as illustrated in FIG. 1. Thus, a paper conveying path is formed by the combination of the paper-thickness-direction regulating guides and the paper-width-direction regulating guides.

Figure 3:
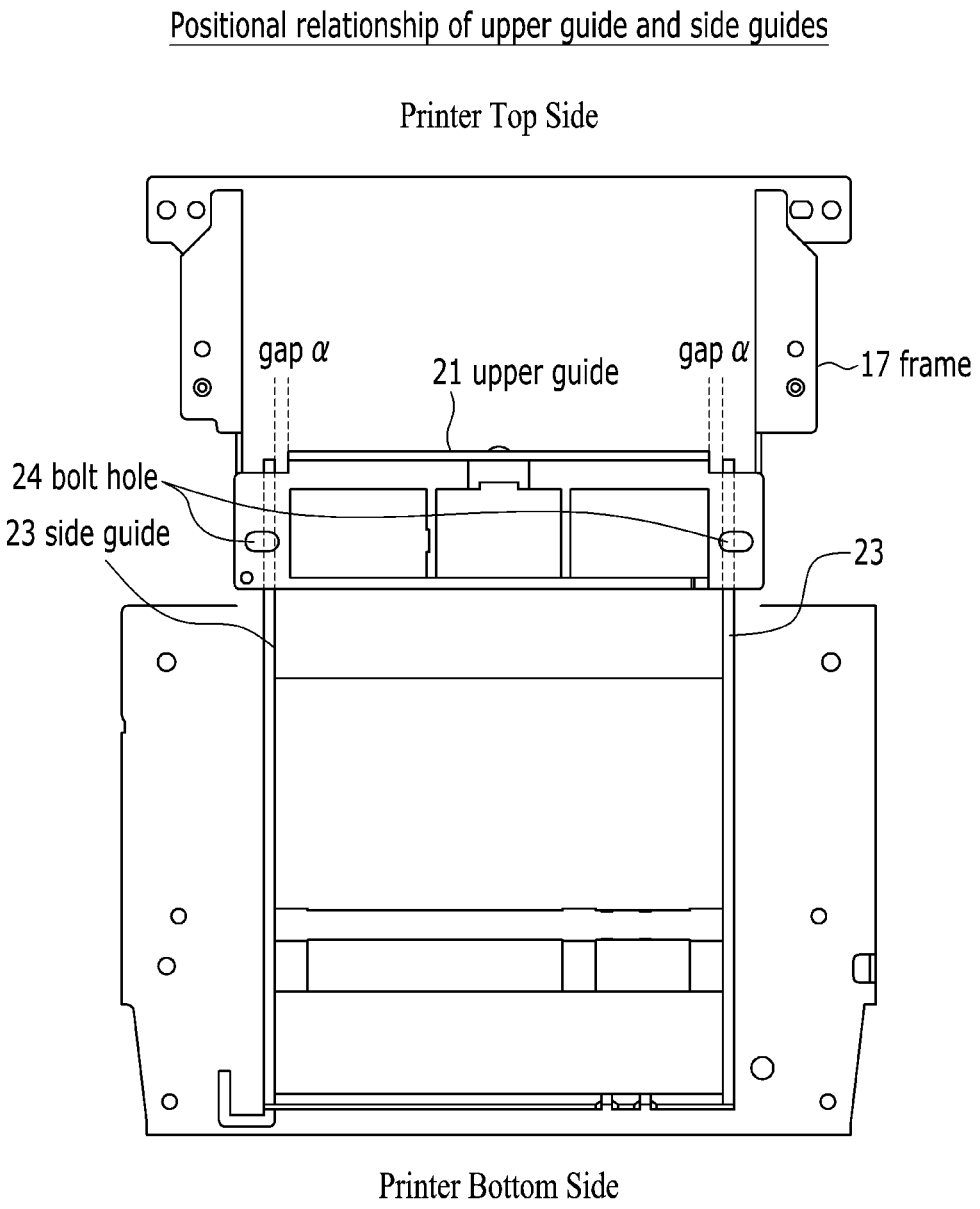
FIG. 3 is a front view illustrating the positional relationship between an upper guide and side guides according to the embodiment.

In such a configuration, the upper guide 21 is housed between the side guides 23 forming the paper-width-direction ends of the paper conveying path. Hereinafter, the side guides 23 forming the paper-width-direction ends of the paper conveying path are also referred to as the side guides 23 on both ends of the paper conveying path. FIG. 3 is a schematic view of the printing apparatus illustrated in FIG. 1 that is seen from the front side (the side on which the paper 100 is discharged from the discharge port 16), and illustrates the positional relationship between the upper guide 21 and the side guides 23. In the embodiment, gaps are provided between the upper guide 21 and the respective side guides 23 so that the opening and closing of the printer cover 15 is not impeded. Specifically, the width of the upper guide 21 in the paper width direction (exclusive of urging members 30 to be described below) is smaller than an inner width W (see FIG. 4A) of the side guides 23 on both ends of the paper conveying path. The inner width W corresponds to the distance between the surface of one of the side guides 23 facing the upper guide 21 and the surface of the other side guide 23 facing the upper guide 21.

As illustrated in FIG. 3, supposing that gaps a of the same size are provided on the two respective sides of the upper guide 21 in the paper width direction, it is preferable that the gap a on one side be larger than 0 mm and not more than 0.5 mm. If no gap is provided between the upper guide 21 and each of the side guides 23, the upper guide 21 would interfere with the side guides 23 to impede the opening and closing of the printer cover 15. If the gap exceeds 0.5 mm, the paper 100, especially a flexible thin paper would be possibly taken into the gap and thus being folded.

Figure 4A:
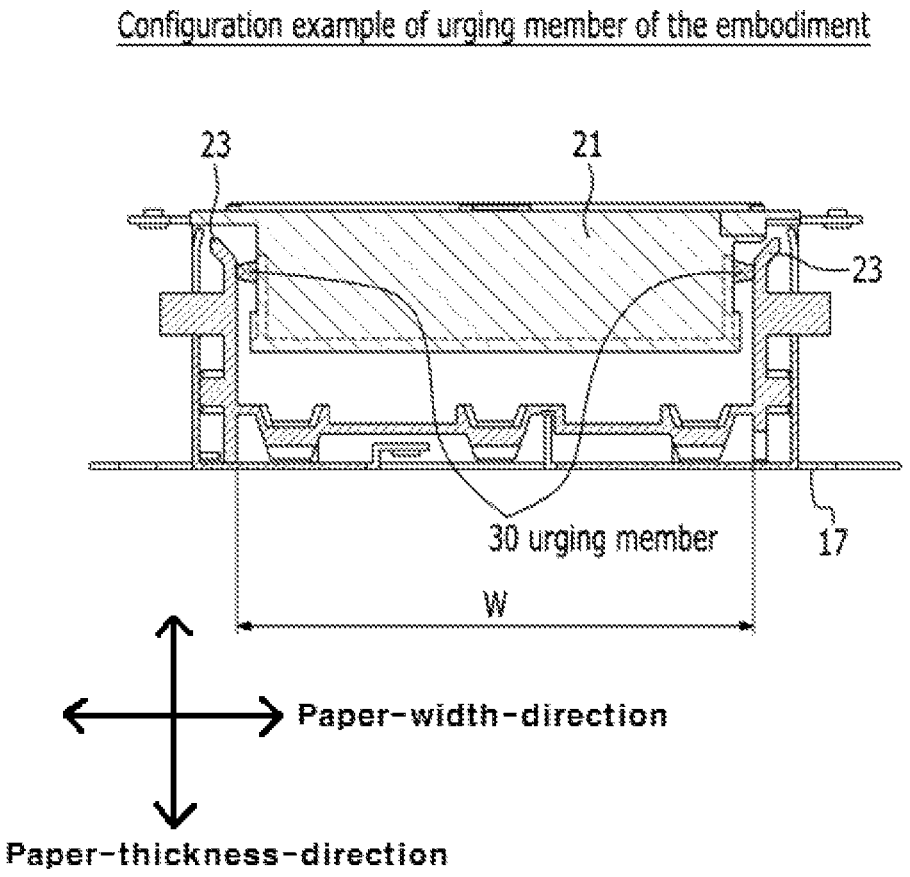
FIGS. 4A and 4B illustrate an exemplary configuration of urging member according to the embodiment.
Figure 4B:
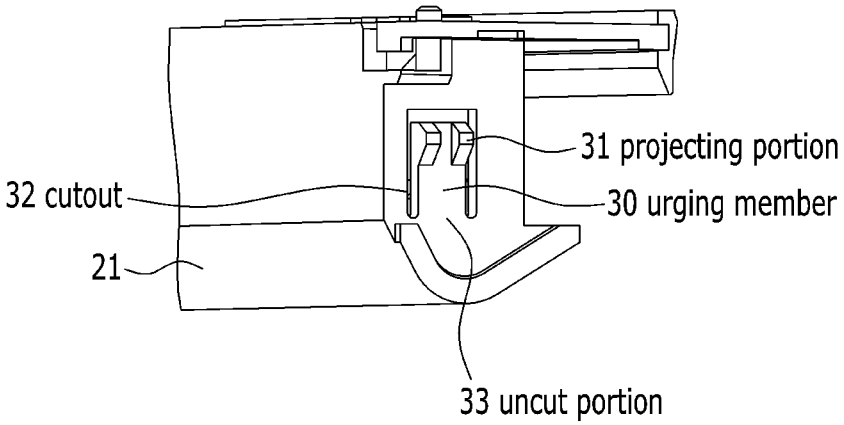

Conventionally, when the printer cover 15 is closed, the upper guide 21 likely leans toward either side in the paper width direction in a space defined by the side guides 23. As a result, the gap formed between the upper guide 21 and each of the side guides 23 is not equally provided on one side and on the other side. In the embodiment, the upper guide 21 is provided with an urging member 30 on each side surface thereof to substantially equally form the gaps however the printer cover 15 is closed. FIGS. 4A and 4B illustrate an exemplary configuration of the urging member 30. FIG. 4A illustrates the urging member 30 provided on the upper guide 21 in a schematic view of the printing apparatus illustrated in FIG. 1, as seen from the printer bottom side. FIG. 4B is a perspective view illustrating a configuration of the urging member 30.

In the embodiment, as illustrated in FIGS. 4A and 4B, the urging members 30 are provided on right and left side surfaces, respectively, of the upper guide 21 facing the respective side guides 23 forming both ends of the paper conveying path (hereinafter, the side surfaces of the upper guide 21 are also referred to as surfaces facing the respective side guides 23). The urging member 30 is of elasticity and provided with a projecting portion 31 projecting toward a corresponding one of the side guides 23. To provide elasticity to the urging member 30, the upper guide 21 is made of an elastic material such as resin, and a cutout 32 is made in a rectangular U shape on the side surface of the upper guide 21. The cutout 32 penetrates the side surface of the upper guide 21 from one side to the other side in the paper width direction. The urging member 30 is thus configured to yield inward in the paper width direction when pressed from outside with an uncut portion 33 of the side surface of the upper guide 21 being a support of the action of the urging member 30.

In the embodiment, the outer width of the upper guide 21 inclusive of the projecting portions 31 of the urging members 30 is greater than the inner width W of the side guides 23 on both ends of the paper conveying path. Therefore, when the printer cover 15 is closed, the projecting portions 31 of the urging members 30 provided on the side surfaces of the upper guide 21 hits the side guides 23. Consequently, the urging members 30 yield inward in the paper width direction.

Thus, when the printer cover 15 is closed, the upper guide 21 is urged in such a manner as to be positioned substantially at the center of the space defined by the inner width W of the side guides 23 without fail. Therefore, the gaps formed between the upper guide 21 and the side guides 23 have substantially the same size, regardless of the way the printer cover 15 is closed. Such a configuration prevents the increase in the size of the gap on one side in the paper width direction. Consequently, the problem that the paper 100 may be taken into the gap and thus be folded is prevented.

The upper guide 21 is fixed to the printer cover 15. Therefore, when the upper guide 21 is shifted by the urging members 30 in such a manner as to be positioned substantially in the center of the space defined by the inner width W of the side guides 23, the printer cover 15 is also shifted in the paper width direction correspondingly. Consequently, the outer side surfaces of the printer cover 15 are not flush with the outer side surfaces of the exterior case 14.

To avoid such bad appearance, the embodiment employs an adjusting mechanism that adjusts the position of upper guide 21 when the upper guide 21 is attached to the printer cover 15. Specifically, as illustrated in FIG. 3, the upper guide 21 is provided with a plurality of bolt holes 24. The upper guide 21 is fixed to the printer cover 15 by fastening bolts into the bolt holes 24. The bolt hole 24 has an oblong shape, not a perfect circular shape, so that the position of the upper guide 21 with respect to the printer cover 15 is adjustable in the paper width direction.

More specifically, the upper guide 21 is temporarily attached to the printer cover 15 with the bolts and then the printer cover 15 is closed. The upper guide 21 is urged by the urging members 30 in such a manner as to be positioned substantially at the center of the space defined by the inner width W of the side guides 23. In this state, the position of the printer cover 15 is manually adjusted to make the outer side surfaces of the printer cover 15 flush with the outer side surfaces of the exterior case 14. Then, the printer cover 15 is opened again, and the bolts are firmly fastened. Thereafter, however the printer cover 15 is closed, the outer side surfaces of the exterior case 14 and the outer side surfaces of the printer cover 15 become flush with each other.

The embodiment has another configuration for preventing the paper 100 from being taken into the gap between the upper guide 21 and each of the side guides 23, in addition to the urging members 30. Specifically, the tension applying member 25 is employed as a mechanism of applying tension acting in the paper thickness direction to the paper 100 that is being conveyed. Thus, a portion of the paper 100 that is being conveyed near the upper guide 21 and the side guides 23 is prevented from being slack.

More specifically, with the printer cover 15 closed as illustrated in FIG. 1, an end 21*a* of the upper guide 21 on a side facing the frame 17 projects toward the tension applying member 25 (toward the frame 17) beyond an end 25*a* of the tension applying member 25 on a side facing the printer cover 15, and the end 25*a* of the tension applying member 25 projects toward the upper guide 21 (toward the printer cover 15) beyond the end 21*a* of the upper guide 21. Hence, the paper conveying path has a curved shape (a substantially S shape).

In such a configuration, a relatively large tension acting in the paper thickness direction is applied to the portion of the paper 100 that is near the upper guide 21 and the side guides 23, preventing the paper 100 from being slack. Consequently, the paper 100 is prevented from being taken into the gap between the upper guide 21 and each of the side guides 23 because of the slack thereof.

The tension applying member 25 may be configured to be rotatably urged toward the frame 17. In such a configuration, as the diameter of the roll of paper 100 is reduced, the tension applying member 25 is rotated toward the upper guide 21. Therefore, the paper conveying path is surely formed in a substantially S shape, and a more preferable tension is applied to the paper 100.

According to the embodiment described above in detail, gaps are provided between the upper guide 21 and the side guides 23 so that the opening and closing of the printer cover 15 is not impeded. Furthermore, the size of the gaps is set to a small value of 0.5 mm or smaller so that the paper 100 is not taken into either of the gaps. Furthermore, according to the embodiment, when the printer cover 15 is closed, the upper guide 21 is urged by the urging members 30 and is thus positioned substantially at the center of the space defined by the inner width W of the side guides 23 without fail. Such a configuration prevents the increase in the size of the gap on one side of the upper guide 21 in the paper width direction.

Although in the above embodiment the projecting portion 31 is provided on the side nearer to the printer cover 15 with respect to the center in the paper thickness direction of the urging member 30 as illustrated in FIG. 4B, the present invention is not limited to such a case. For example, the projecting portion 31 may be provided on the side nearer to the lower guide 22 with respect to the center in the paper thickness direction of the urging member 30. In such an exemplary configuration, the cutout 32 having a rectangular U shape may be inverted by 180 degrees so that the projecting portion 31 and the uncut portion 33 are inverted. Thus, the size of the gaps that may take in the paper 100 is reduced, and the probability that the paper 100 may be folded is reduced.

Figure 5A:
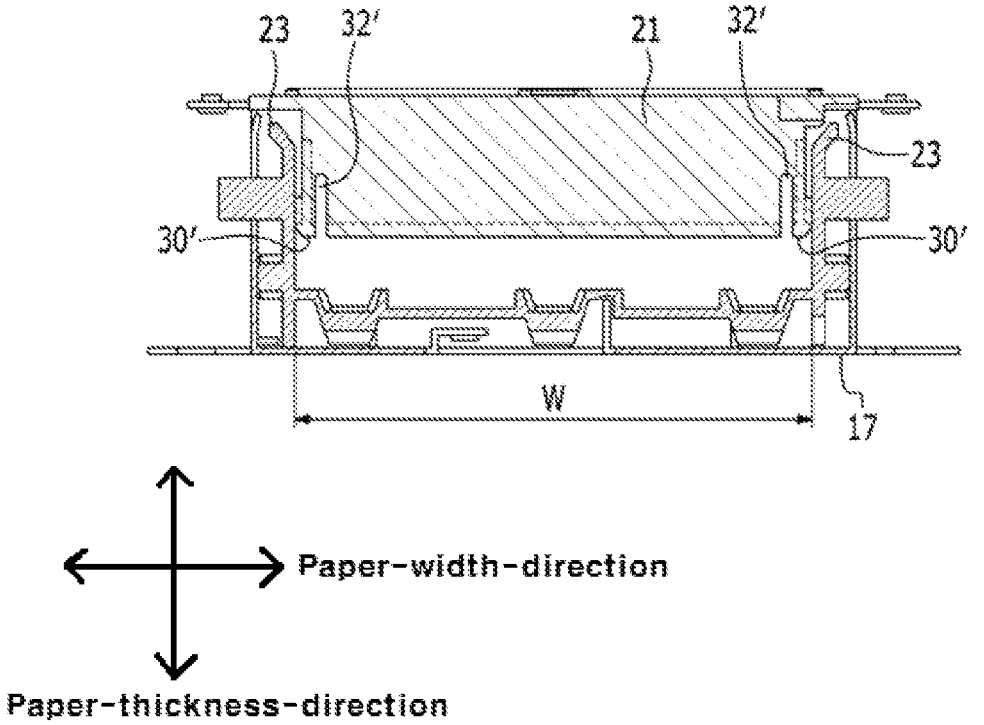
FIGS. 5A and 5B illustrate another exemplary configuration of the urging member according to the embodiment.
Figure 5B:
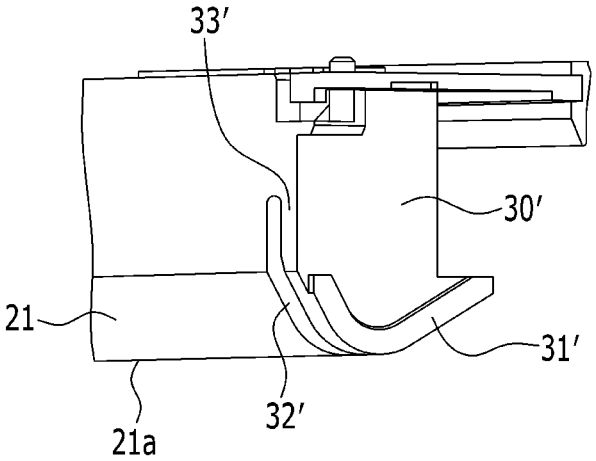
Figure 6:
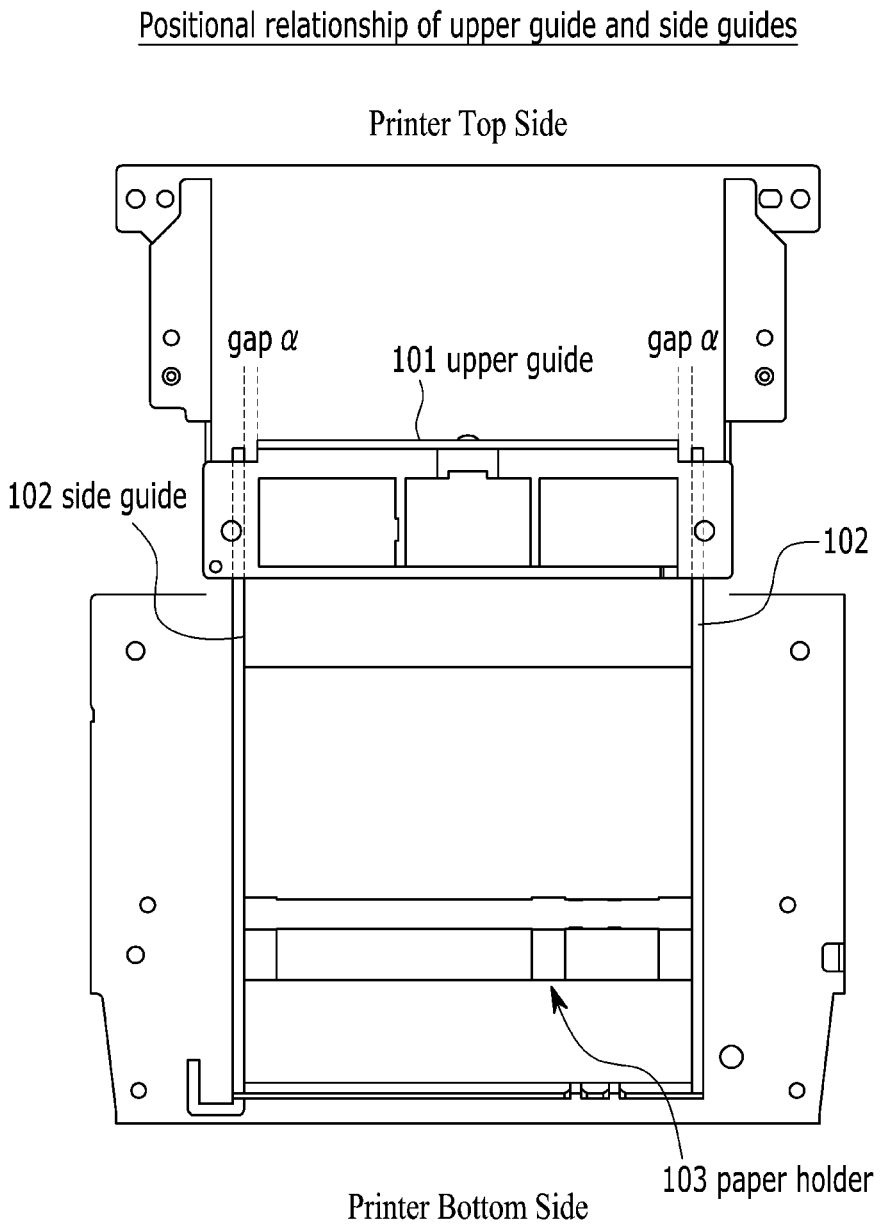
FIG. 6 is a front view of a known printer and illustrates the positional relationship between an upper guide and side guides.
Figure 7:
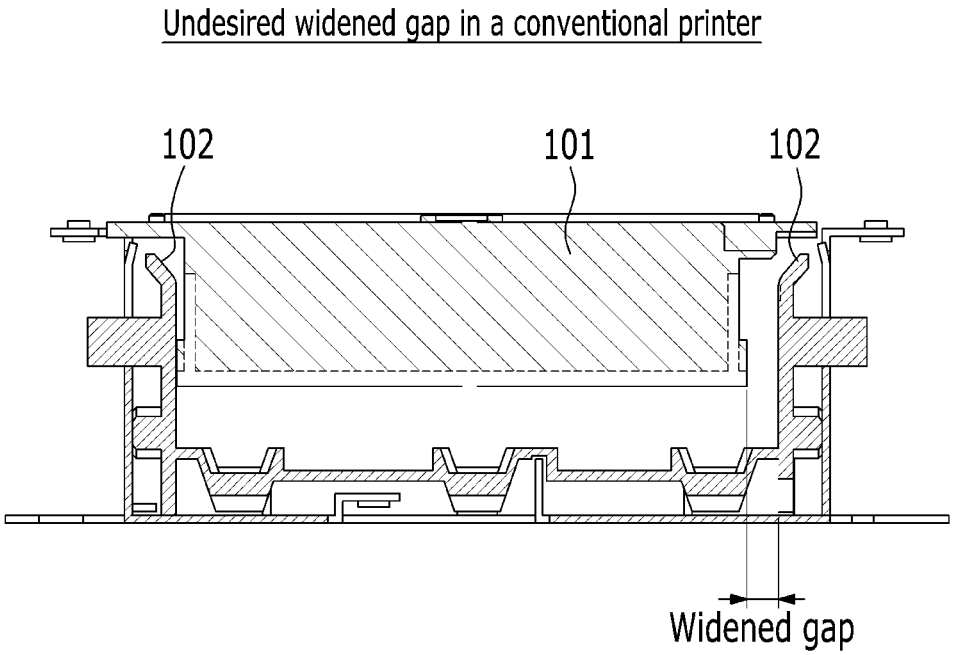
FIG. 7 illustrates a state of gaps that may be produced in the known printer depending on the way a printer cover is closed.

Alternatively, an urging member 30' may be configured as illustrated in FIGS. 5A and 5B. A projecting portion 31' is provided at the edge of the side surface of the upper guide 21 on the side facing the frame 17 so as to extend along and in conformity with the shape of the edge. Furthermore, a cutout 32' is provided in an inner position in the paper width direction by a predetermined interval from the side surface of the upper guide 21. The cutout 32' is extended parallel to the side surface of the upper guide 21.

The cutout 32' has a predetermined length in the paper thickness direction from the end 21*a* of the upper guide 21 on the side facing the paper 100 toward the printer cover 15. Accordingly, a portion of the upper guide 21 at an end of the cutout 32' on the side facing the printer cover 15 functions as an uncut portion 33' of the urging member 30'. That is, the thickness of the upper guide 21 from the side surface thereof to the cutout 32' corresponds to the thickness of the urging member 30' while the length of the cutout 32' from the end 21*a* of the upper guide 21 corresponds to the length of the urging member 30'. Since the urging member 30' is provided by making the cutout 32' in the upper guide 21, an end surface of the urging member 30' on the side facing the paper 100 and an end surface of the upper guide 21 on the side facing the paper 100 are configured to be flush with each other.

In this configuration also, the outer width of the upper guide 21 inclusive of the projecting portions 31' of the urging members 30' is greater than the inner width W of the side guides 23. When the printer cover 15 is closed, the urging members 30' yields in the thickness direction of the side surface of the upper guide 21 (toward the cutout 32') with the uncut portions 33' functioning as a support of the action of the urging member 30'.

In such a configuration, when the printer cover 15 is closed, the upper guide 21 is urged in such a manner as to be positioned substantially at the center of the space defined by the inner width W of the side guides 23 without fail. Hence, gaps having substantially the same size are produced on the two respective sides of the upper guide 21, regardless of the way the printer cover 15 is closed. Thus, the increase in the size of the gap on one side in the paper width direction is prevented. Consequently, the problem that the paper 100 may be taken into the gap and be folded is prevented.

Furthermore, in the configuration illustrated in FIGS. 5A and 5B, the gaps between the upper guide 21 and the side guides 23 are completely closed by the edges of the upper guide 21 that are on the side facing the frame 17. Therefore, the problem that the paper 100 may be taken into the gap and be folded is more assuredly prevented. Setting the thickness of each of the cuts 32' to 0.5 mm or smaller also prevents the paper 100 from being taken into the cuts 32' and being folded.

The opening of the cutout 32' is narrowed as the urging member 30' yields inward in the paper width direction. Hence, there is almost no chance that the paper 100 is taken into the cutout 32'. The outer width of the upper guide 21 inclusive of the projecting portions 31' and the width of the cutout 32' may be designed to completely close the opening of the cutout 32' with the action of the urging member 30'. A problem of the paper 100 taken into the cuts 32' is almost completely prevented.

Although in the above embodiment the urging member (30, 30') is provided on the side surface of the upper guide 21, the present invention is not limited to such a case. For example, the urging member may be provided on a surface of the side guide 23 facing the upper guide 21. The urging member in such a configuration is of elasticity and provided with a projecting portion that project toward the upper guide 21. Furthermore, the inner width W of the side guides 23 inclusive of the projecting portions of the urging members is smaller than the outer width of the upper guide 21. In this configuration, the projecting portion is preferably provided in a position nearest to the lower guide 22 on the urging member.

Although the above embodiment concerns a case where the urging member (30, 30') is provided as part of the upper guide 21, the urging member may be provided separately from the upper guide 21. For example, an elastic urging member (such as a coil spring or leaf spring) may be provided to be engaged with the upper guide 21.

It should be understood that the configurations according to the above embodiment are only exemplary in embodying the present invention and they should not be considered as a limitation on the technical scope of the present invention. That is, the present invention can be embodied in various other ways without departing from the essence or the features thereof.

What is claimed is:

1. A paper conveying mechanism for a printing apparatus, the printing apparatus comprising a printer body having a frame, and a printer cover to be opened from the printer body and closed to the printer body, the paper conveying mechanism comprising:

a paper-thickness-direction regulating guide including an upper guide, the upper guide being mounted on the printer cover;

a pair of paper-width-direction regulating guides mounted on the printer body to form a pair of side guides of a paper conveying path in combination with the paper-thickness-direction regulating guide in a state that the printer cover is closed to the printer body; and a first and a second elastic urging members respectively provided on opposite side surfaces of the upper guide facing the paper-width-direction regulating guides, the first elastic urging member being provided with a first projecting portion that projects toward one of the paper-width-direction regulating guides, the second elastic urging member being provided with a second projecting portion that projects toward the other of the paper-width-direction regulating guides, wherein a distance between a projecting end of the first projecting portion and a projecting end of the second projecting portion is greater than an inner width of the pair of paper-width-direction regulating guides in a state that the printer cover is opened, and wherein the upper guide is housed between the pair of paper-width-direction regulating guides in a state that the printer cover is closed to the printer body with the first and the second projecting portions in an elastic contact with the pair of paper-width-direction regulating guides.

2. The paper conveying mechanism for a printing apparatus according to claim 1, wherein the paper-thickness-direction regulating guide further includes a lower guide, and wherein the first and the second projecting portions are provided in a position on sides nearer to the lower guide with respect to the center in a paper thickness direction of the first and the second elastic urging members.

3. The paper conveying mechanism for a printing apparatus according to claim 1, wherein ends of the first and the second elastic urging members on sides facing a paper are configured to be flush with an end of the upper guide on a side facing the paper.

4. The paper conveying mechanism for a printing apparatus according to claim 2, wherein ends of the first and the second elastic urging members on sides facing a paper are configured to be flush with an end of the upper guide on a side facing the paper.

5. The paper conveying mechanism for a printing apparatus according to claim 1, wherein the paper-thickness-direction regulating guide further includes a tension applying member, and wherein an end of the tension applying member facing the printer cover projects toward the printer cover beyond an end of the upper guide facing the frame to shape the paper conveying path into a curve.

6. The paper conveying mechanism for a printing apparatus according to claim 2, wherein the paper-thickness-direction regulating guide further includes a tension applying member, and wherein an end of the upper guide on a side facing a paper is configured to project toward the tension applying member beyond an end of the tension applying member on a side facing the paper while the end of the tension applying member on a side facing the paper is configured to project toward the upper guide beyond the end of the upper guide on a side facing the paper to shape the paper conveying path into a curve.

7. The paper conveying mechanism for a printing apparatus according to claim 3, wherein the paper-thickness-direction regulating guide further includes a tension applying member, and wherein an end of the upper guide on a side facing a paper is configured to project toward the tension applying member beyond an end of the tension applying member on a side facing the paper while the end of the tension applying member on a side facing the paper is configured to project toward the upper guide beyond the end of the upper guide on a side facing the paper to shape the paper conveying path into a curve.

8. The paper conveying mechanism for a printing apparatus according to claim 4, wherein the paper-thickness-direction regulating guide further includes a tension applying member, and wherein an end of the upper guide on a side facing a paper is configured to project toward the tension applying member beyond an end of the tension applying member on a side facing the paper while the end of the tension applying member on a side facing the paper is configured to project toward the upper guide beyond the end of the upper guide on a side facing the paper to shape the paper conveying path into a curve.

9. The paper conveying mechanism for a printing apparatus according to claim 1, wherein the first and second projecting portions are positioned nearer the printer cover than the frame.

10. The paper conveying mechanism for a printing apparatus according to claim 9, wherein the paper-thickness-direction regulating guide further includes a tension applying member, and wherein an end of the tension applying member facing the printer cover projects toward the printer cover beyond an end of the upper guide facing the frame to shape the paper conveying path into a curve.

* * * * *